US008471654B1

(12) United States Patent
Shanmugaraj et al.

(10) Patent No.: US 8,471,654 B1
(45) Date of Patent: Jun. 25, 2013

(54) CIRCUIT PROTECTION DEVICE AND FLUX SHIFTER FOR A CIRCUIT PROTECTION DEVICE

(71) Applicant: General Electric Company, Schenectady, NY (US)

(72) Inventors: Umashankar Shanmugaraj, Tamilnadu (IN); Lars Pommerencke, Neumunster (DE); Amit Bose, Secunderabad (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/660,539

(22) Filed: Oct. 25, 2012

(51) Int. Cl.
*H01H 9/20* (2006.01)
*H01H 9/00* (2006.01)

(52) U.S. Cl.
USPC ..... 335/21; 335/166; 335/167; 335/168; 335/170; 335/171; 335/172; 335/174; 335/175

(58) Field of Classification Search
USPC ..... 335/21, 166–168, 170–172, 174, 335/175
See application file for complete search history.

(56) References Cited

U.S. PATENT DOCUMENTS

| | | | | |
|---|---|---|---|---|
| 4,594,491 | A | 6/1986 | Leone et al. | |
| 6,015,959 | A | 1/2000 | Slepian et al. | |
| 6,072,136 | A | 6/2000 | Wehrli, III et al. | |
| 6,201,460 | B1 | 3/2001 | Winslett et al. | |
| 6,421,217 | B1 * | 7/2002 | Castonguay et al. | 361/115 |
| 6,437,269 | B1 | 8/2002 | Rakus | |
| 7,115,830 | B1 | 10/2006 | Weister et al. | |
| 2002/0050886 | A1 | 5/2002 | Leone et al. | |
| 2009/0174508 | A1 | 7/2009 | Watford et al. | |

FOREIGN PATENT DOCUMENTS

| | | | |
|---|---|---|---|
| EP | 0923102 | A3 | 10/2000 |

OTHER PUBLICATIONS

Seungki et al., Design of Electromagnetic Force Driving Actuator (EMFA) and Linkage for Molded Case Circuit Breaker, Electrical Machines and systems (ICEMS), 2010 International Conference, Oct. 10-13, 2010; pp. 2573-1577, ISBN: 978-1-4244-7720-3.

* cited by examiner

*Primary Examiner* — Ramon Barrera
(74) *Attorney, Agent, or Firm* — Global Patent Operation

(57) ABSTRACT

A flux shifter for a circuit protection device including a trip mechanism includes a trip arm and a pin assembly. The pin assembly includes a pin, a biasing member positioned proximate to the pin, and a latch coupled to the pin and to the biasing member. The pin assembly is configured to enable the trip arm to rotate into an engagement with the trip mechanism when the flux shifter enters a trip state and to prevent the trip arm from rotating into the engagement with the trip mechanism when the flux shifter is in one of an operational state and a reset state.

26 Claims, 18 Drawing Sheets

CIRCUIT PROTECTION DEVICE AND FLUX SHIFTER FOR A CIRCUIT PROTECTION DEVICE

BACKGROUND OF THE INVENTION

The present application relates generally to power distribution systems and, more particularly, to a circuit protection device and a flux shifter for a circuit protection device.

Known electrical distribution circuits include a plurality of switchgear or other circuit breakers that are coupled to one or more loads. The switchgear and/or circuit breakers typically include a trip mechanism that interrupts current flowing to the loads if the current exceeds a current threshold and/or if the current otherwise is outside of acceptable operating conditions.

At least some known circuit breakers and/or switchgear include a flux shifter device that activates the trip mechanism when the current exceeds the current threshold. The flux shifter device generally includes a solenoid that emits a magnetic field in response to a trip signal received from a trip unit, for example. The magnetic field causes a plunger to be released from a latched position within the flux shifter. The plunger impacts one or more components of the flux shifter device to activate the trip mechanism. However, at least some known flux shifter devices include a large number of components that undesirably increase a cost and/or a weight of the flux shifter device. In addition, at least some known flux shifter devices fitted as a single device inside a circuit breaker experience undesirable vibrations and/or shocks during operation of the circuit breaker and/or accessories of the circuit breaker. Such vibrations and/or shocks may impede the operation of, and/or damage, the circuit breaker and/or the flux shifter.

BRIEF DESCRIPTION OF THE INVENTION

In one aspect, a flux shifter for a circuit protection device including a trip mechanism is provided that includes a trip arm and a pin assembly. The pin assembly includes a pin, a biasing member positioned proximate to the pin, and a latch coupled to the pin and to the biasing member. The pin assembly is configured to enable the trip arm to rotate into an engagement with the trip mechanism when the flux shifter enters a trip state and to prevent the trip arm from rotating into the engagement with the trip mechanism when the flux shifter is in one of an operational state and a reset state.

In another aspect, a circuit protection device is provided that includes a trip mechanism configured to interrupt a current, and a flux shifter configured to activate the trip mechanism to interrupt the current. The flux shifter includes a trip arm and a pin assembly. The pin assembly includes a pin, a biasing member positioned proximate to the pin, and a latch coupled to the pin and to the biasing member. The pin assembly is configured to enable the trip arm to rotate into an engagement with the trip mechanism when the flux shifter enters a trip state and to prevent the trip arm from rotating into the engagement with the trip mechanism when the flux shifter is in one of an operational state and a reset state.

In yet another aspect, a flux shifter is provided for a circuit protection device including a trip mechanism. The flux shifter includes a trip arm and a pin assembly. The pin assembly includes a latch, an engagement pin coupled to the latch, and a reset pin coupled to the latch. The pin assembly is configured to enable the trip arm to rotate into an engagement with the trip mechanism when the flux shifter enters a trip state and to prevent the trip arm from rotating into the engagement with the trip mechanism when the flux shifter is in one of an operational state and a reset state.

BRIEF DESCRIPTION OF THE DRAWINGS

FIG. 3 is a perspective bottom view of the flux shifter shown in

FIG. 2.

DETAILED DESCRIPTION OF THE INVENTION

Figure 1:
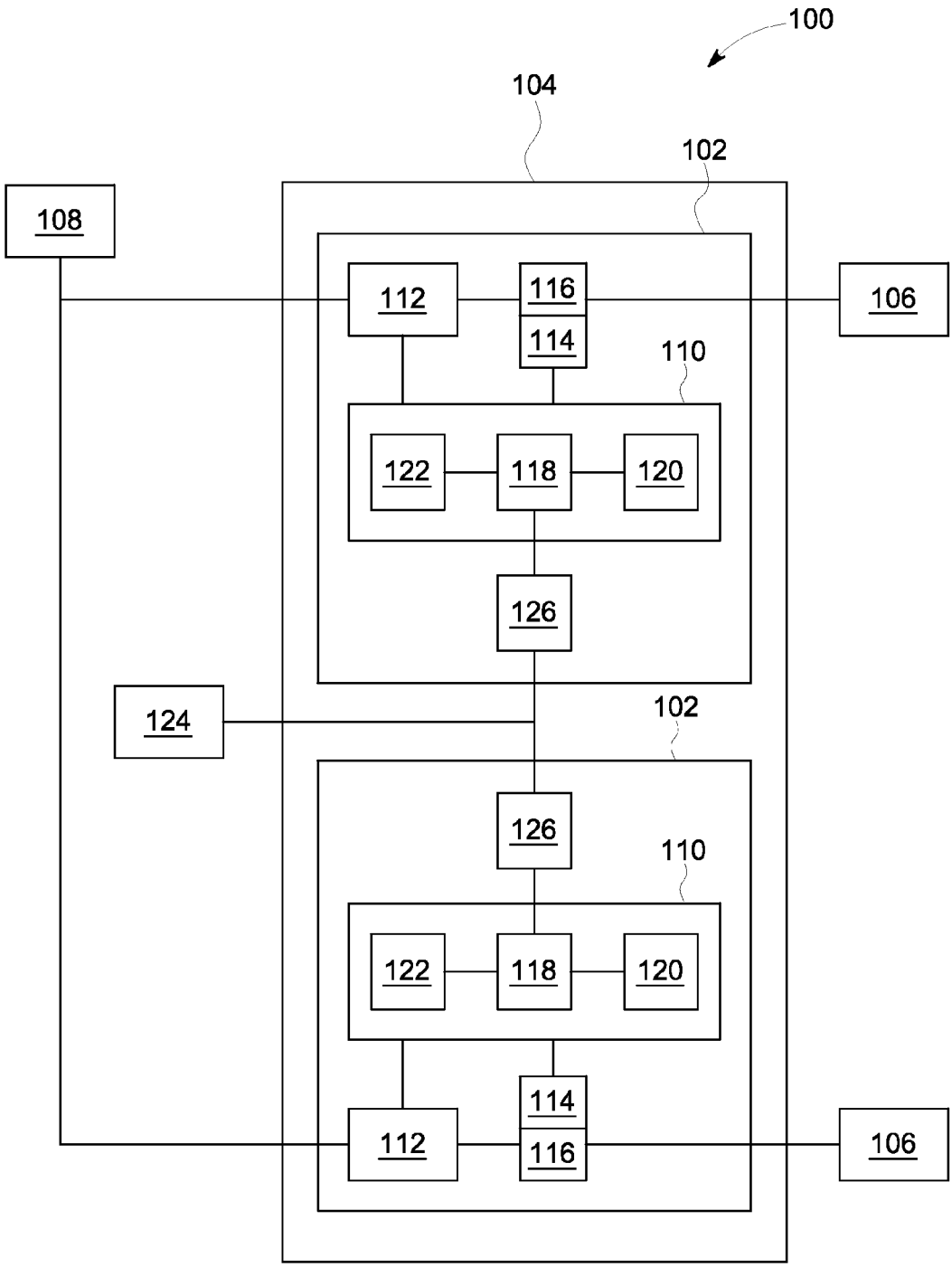
FIG. 1 is a schematic block diagram of an exemplary power distribution system including a plurality of circuit protection devices and a plurality of flux shifters of the circuit protection devices.

Exemplary embodiments of a circuit protection device and a flux shifter for a circuit protection device are described herein. The flux shifter includes a trip arm, a plunger, and a pin assembly that includes a pin, a pin biasing member, and a latch. In addition, a trip paddle is formed on the trip arm. During an operational state and during a reset state of the flux shifter, a notch portion of the pin prevents the trip arm from rotating due to a biasing force applied by a trip arm biasing member. The plunger is held in the operational state by a permanent magnet housed within a solenoid of the flux shifter. The plunger is coupled to a biasing member that is compressed such that spring elastic energy is stored.

During a trip state of the flux shifter, the solenoid receives a trip signal and generates an electro-magnetic field that opposes the permanent magnet. The electro-magnetic field effectively cancels the field generated by the permanent magnet, and the spring elastic energy is converted to kinetic energy. The plunger is propelled out of the solenoid by the kinetic energy and impacts the latch, causing the latch to rotate. The rotation of the latch causes the pin to rotate. The notch portion rotates into a position in which the trip arm is enabled to rotate. The biasing force of the trip arm biasing member causes the trip arm to rotate past the notch portion. The trip paddle rotates into an engagement with the trip mechanism to cause the trip mechanism to activate, thus interrupting current flowing to a load.

During a reset operation of the flux shifter (i.e., when the flux shifter enters the reset state), the trip arm rotates by an application of force from a handle assembly on a surface of the trip arm. The pin assembly is locked against an engagement surface of the trip arm by a notch in the pin during the first part of the reset operation. In addition, during the first part of the reset operation, the pin assembly biasing member experiences torsional deflection due to the external force on the trip arm and operates as a flexible member or as a spring. During the second part of the reset operation, the trip arm moves with respect to the pin. At a position where the engagement surface reaches a center of the notch portion, the notch portion is able to rotate past the engagement surface of the trip arm. The pin assembly starts rotating in a clockwise direction, and the latch engages with the plunger. The latch pushes the plunger inside the solenoid, thus overcoming the force of the plunger biasing member. The pin assembly biasing member operates as solid pin transmitting the force from the trip arm to the latch to push the plunger into the solenoid and into the reset state. Thus the pin assembly, including the pin assembly biasing member, operates as a dual purpose pin during the reset operation. The pin assembly biasing member is flexible during the first part of the reset operation as a true or ideal spring, and operates as a solid pin during the second part of the reset operation. Accordingly, the flux shifter described herein provides a robust and effective trip activation and latching functionality to the circuit protection device using fewer components than at least some known flux shifters. In addition, the rotatable parts of the pin assembly facilitate reducing vibrations that may otherwise be present within the flux shifter due to the operation of the plunger.

FIG. 1 is a schematic block diagram of an exemplary power distribution system 100 including a plurality of circuit protection devices 102. In one embodiment, each circuit protection device 102 is removably coupled within a switchgear unit 104 and is configured to programmably control power distributed to one or more loads 106.

Loads 106 may include, but are not limited to only including, machinery, motors, lighting, and/or other electrical and mechanical equipment of a manufacturing or power generation or distribution facility. Power is provided to switchgear unit 104 from an electrical distribution line 108, which is also coupled to circuit protection device 102.

Each circuit protection device 102 includes a trip unit 110 for controlling circuit protection device 102. In an exemplary embodiment, trip unit 110 is an electronic trip unit (ETU). In addition, each circuit protection device 102 includes at least one sensor 112, at least one flux shifter 114, and at least one trip mechanism 116. Sensor 112 and flux shifter 114 are operatively coupled to trip unit 110, and trip mechanism 116 is operatively coupled to flux shifter 114.

Trip unit 110 includes a processor 118 and a memory 120 coupled to processor 118. In one embodiment, trip unit 110 also includes a display device 122 coupled to processor 118.

It should be understood that the term "processor" refers generally to any programmable system including systems and microcontrollers, reduced instruction set circuits (RISC), application specific integrated circuits (ASIC), programmable logic circuits, and any other circuit or processor capable of executing the functions described herein. The above examples are exemplary only, and thus are not intended to limit in any way the definition and/or meaning of the term "processor."

Memory 120 stores program code and instructions, executable by processor 118, to control and/or monitor circuit protection device 102 and/or trip mechanism 116. In an exemplary embodiment, memory 120 includes non-volatile RAM to enable data stored in memory 120 to be retained after a power loss. Alternatively or additionally, memory 120 may include magnetic RAM (MRAM), ferroelectric RAM (FeRAM), read only memory (ROM), flash memory and/or Electrically Erasable Programmable Read Only Memory (EEPROM). Any other suitable magnetic, optical and/or semiconductor memory, by itself or in combination with other forms of memory, may be included in memory 120. Memory 120 may also be, or include, a detachable or removable memory, including, but not limited to, a suitable cartridge, disk, CD ROM, DVD or USB memory.

In an exemplary embodiment, display device 122 includes one or more light-emitting diodes (LEDs) that indicate a status of circuit protection device 102 and/or trip unit 110. For example, processor 118 may activate one or more components (e.g., LEDs) of display device 122 to indicate that circuit protection device 102 and/or trip unit 110 is active and/or operating normally, that a fault or failure has occurred, and/or any other status of trip unit 110 and/or circuit protection device 102.

In an exemplary embodiment, sensor 112 is a current sensor, such as a current transformer, a Rogowski coil, a Hall-effect sensor, and/or a shunt that measures a current flowing through trip mechanism 116. Alternatively, sensor 112 may include any other sensor that enables power distribution system 100 to function as described herein. In an exemplary embodiment, each sensor 112 generates a signal representative of the measured or detected current (hereinafter referred to as "current signal") flowing through an associated trip mechanism 116. In addition, each sensor 112 transmits the current signal to processor 118 associated with trip mechanism 116. Each processor 118 is programmed to activate trip mechanism 116 to interrupt a current provided to a load 106 if the current signal, and/or the current represented by the current signal, exceeds a programmable current threshold.

Flux shifter 114 is an electromechanical device that is coupled to processor 118 and that generates a magnetic field in response to a control signal, such as a trip signal, received from processor 118. Flux shifter 114 is positioned proximate to, and/or operably coupled to, trip mechanism 116. The magnetic field causes flux shifter 114 to activate trip mechanism 116, thus preventing current from flowing through trip mechanism 116 and/or circuit protection device 102 to load 106. Alternatively, any suitable actuator may be used to activate trip mechanism 116 in response to the control signal received from processor 118.

In an exemplary embodiment, trip mechanism 116 includes one or more circuit breaker devices. Exemplary circuit breaker devices include, for example, circuit switches, contact arms, and/or circuit interrupters that interrupt current flow through the circuit breaker device to a load coupled to the circuit breaker device. Alternatively, trip mechanism 116 is any other mechanism or device that interrupts current flow when trip mechanism 116 is activated, for example, by flux shifter 114.

In one embodiment, processors 118 are also communicatively coupled to a central controller 124 that controls an operation of power distribution system 100. For example, processors 118 may be directly coupled for communication with central controller 124, or may be coupled for communication with central controller 124 through a communication unit 126. Communication between processors 118 and central controller 124 may also be provided through a hardwired communication link or through a wireless communication link. Processors 118 collect measured operating condition data relating to a corresponding trip mechanism 116. For example, each processor 118 gathers measured operating condition data, such as data representative of the current signal (also referred to herein as "current data"), from a sensor 112 associated with trip unit 110. Processor 118 stores the current data in a memory 120 coupled to processor 118, and/or transmits the current data to central controller 124.

While circuit protection device 102 has been described in FIG. 1 with reference to switchgear units 104 of power distribution system 100, it should be recognized that circuit protection device 102, or any components thereof, may be used with any device or system that enables power distribution system 100 to function as described herein.

During operation, AC current is received from electrical distribution line 108 and is transmitted through sensor 112 and trip mechanism 116 to load 106. Sensor 112 generates a current signal representative of the amount of current flowing through trip mechanism 116 and transmits the current signal to trip unit 110. Processor 118 receives data representative of the current signal (for example, after the signal has been converted from analog to digital data) and analyzes the data to determine whether a fault has occurred within power distribution system 100. For example, processor 118 compares the current amplitude to one or more predetermined current thresholds that are stored in memory 120 to determine whether the current amplitude exceeds the current threshold. If the amplitude of the current flowing through trip mechanism 116 exceeds the current threshold, processor 118 transmits a control signal to flux shifter 114 to cause trip mechanism 116 to be activated.

Flux shifter 114 receives the control signal and generates a magnetic field in response to the control signal. The magnetic field causes flux shifter 114 to trip, or activate, trip mechanism 116 to prevent current from flowing through trip mechanism 116, thus electrically disconnecting load 106 from electrical distribution line 108.

Figure 2:
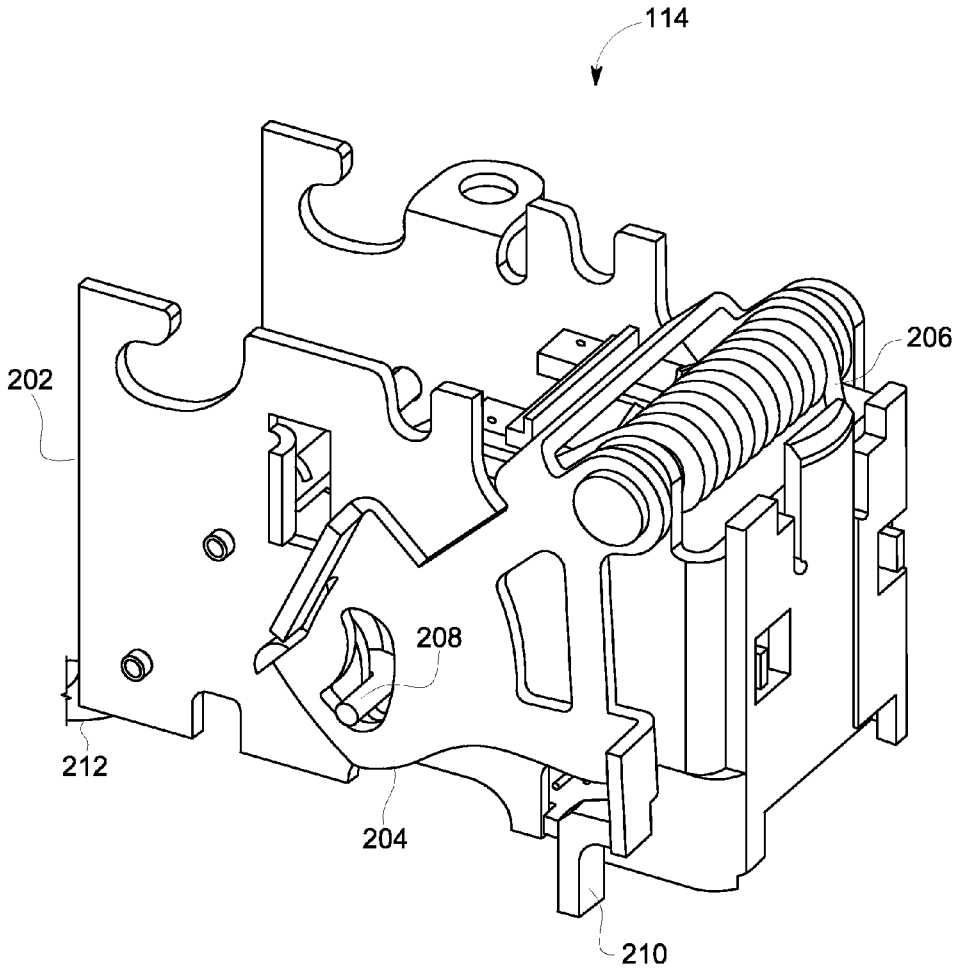
FIG. 2 is a perspective side view of a portion of an exemplary flux shifter that may be used with the circuit protection device shown in FIG. 1.
Figure 3:
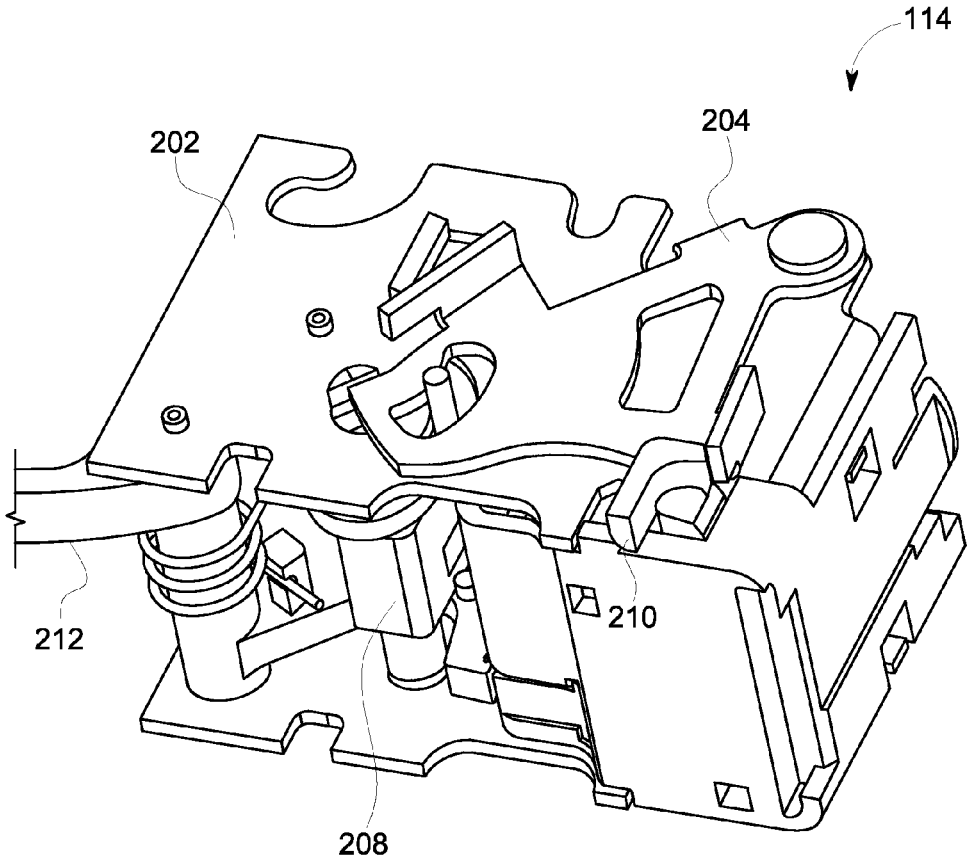

FIG. 2 is a perspective side view of a portion of an exemplary flux shifter 114 that may be used with power distribution system 100 and/or circuit protection device 102 (both shown in FIG. 1). FIG. 3 is a perspective bottom view of flux shifter 114.

In an exemplary embodiment, flux shifter 114 includes a support frame 202, a trip arm 204, a trip arm biasing member 206, a pin assembly 208, a lever 210, and a bell alarm 212. Flux shifter 114 also includes a spring-loaded plunger and a solenoid (neither shown in FIGS. 2 and 3) for activating trip mechanism 116 (shown in FIG. 1). Trip arm biasing member 206 includes, for example, a torsion spring coupled to trip arm 204. Alternatively, trip arm biasing member 206 includes any suitable biasing member that enables flux shifter 114 to function as described herein.

Figure 4:
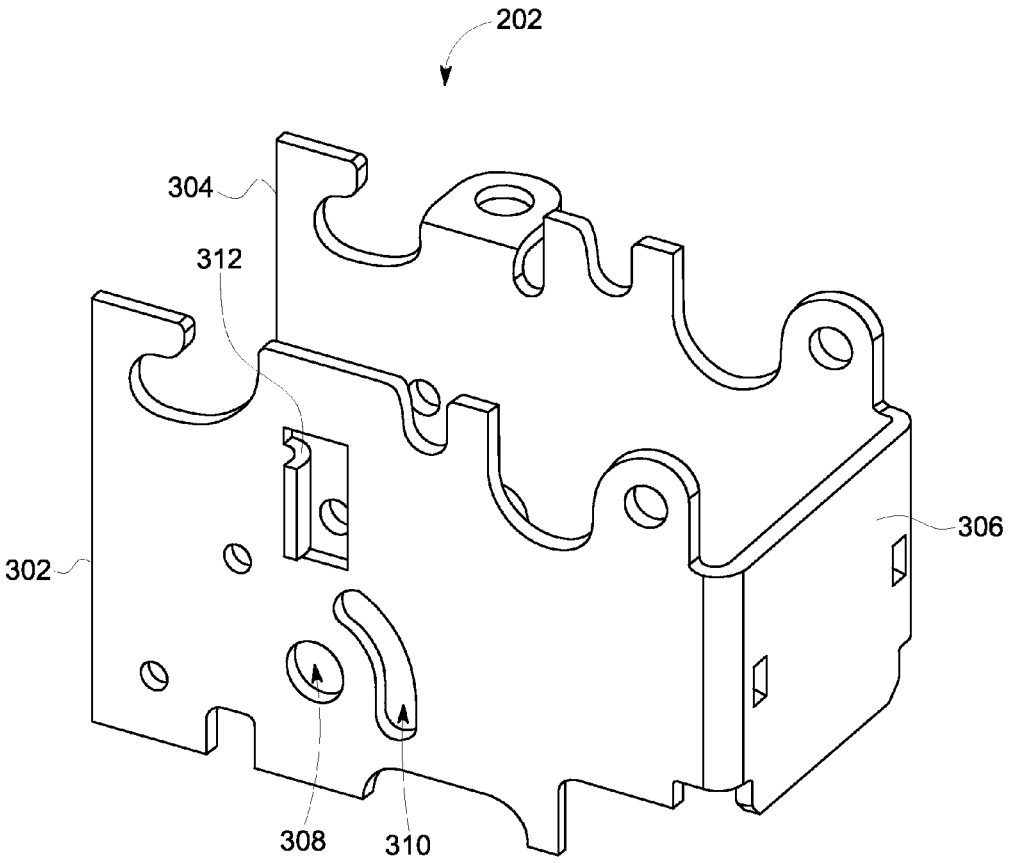
FIG. 4 is a perspective view of an exemplary support frame that may be used with the flux shifter shown in FIG. 1.

FIG. 4 is a perspective view of an exemplary support frame 202 that may be used with flux shifter 114 (shown in FIG. 1). Support frame 202 may be manufactured from a metal and/or a metal alloy. Alternatively, support frame 202 may be manufactured from any suitable material. Support frame 202 facilitates protecting and housing components of flux shifter 114.

In an exemplary embodiment, support frame 202 includes a first side portion 302, an opposing second side portion 304, and a connecting portion 306 coupled to first side portion 302 and second side portion 304. An opening 308 is defined within first side portion 302 and second side portion 304, and a slot or channel 310 is defined within first side portion 302. In an exemplary embodiment, each opening 308 is substantially circular, and slot 310 is substantially arcuate for receiving one or more portions of pin assembly 208 therethrough. Alternatively, openings 308 and/or slots 310 may have any suitable shape that enables flux shifter 114 to function as described herein.

In addition, support frame 202 includes a flange 312 that extends from first side portion 302. Flange 312 is shaped and sized to engage a portion of trip arm 204 and to limit a rotational movement of the portion.

Figure 5:
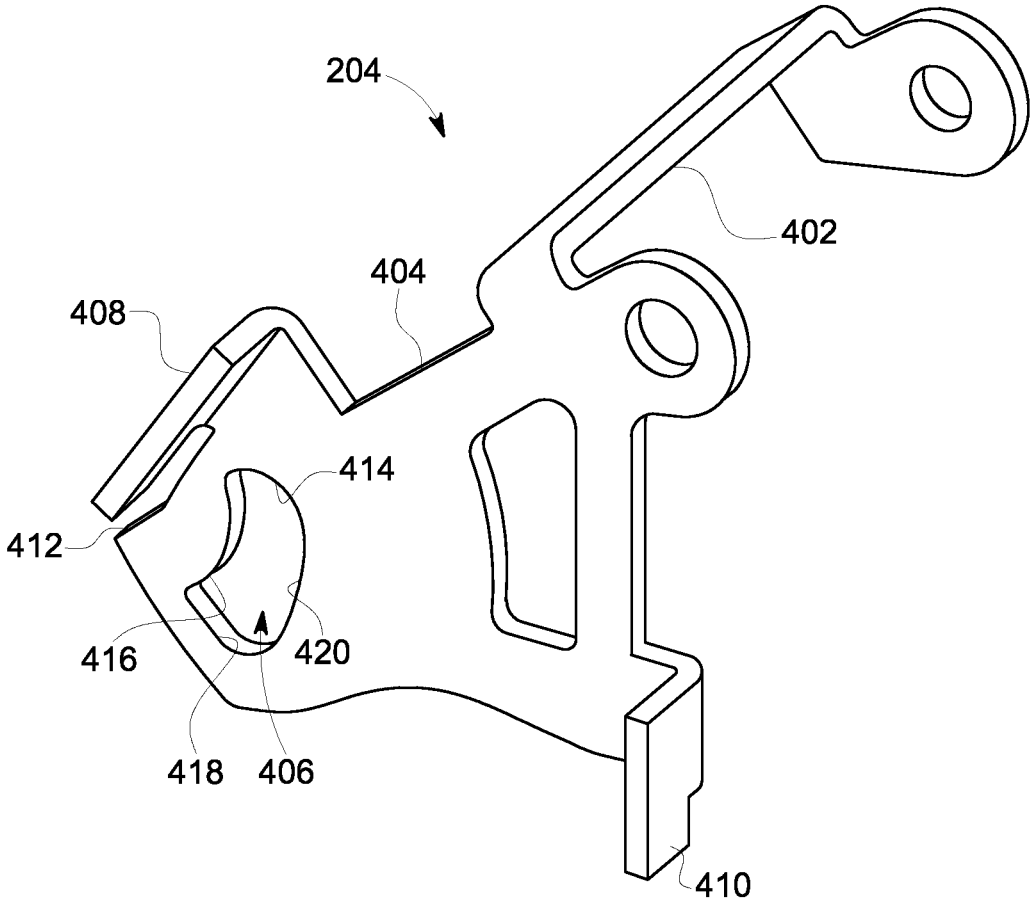
FIG. 5 is a perspective view of an exemplary trip arm that may be used with the flux shifter shown in FIG. 1.

FIG. 5 is a perspective view of an exemplary trip arm 204 that may be used with flux shifter 114 (shown in FIG. 1). In an exemplary embodiment, trip arm 204 includes a support portion 402 that encloses trip arm biasing member 206 (shown in FIG. 2), and a side portion 404 coupled to support portion 402. A guide portion 406, such as a substantially arcuate slot or groove 406, is defined within side portion 404. In addition, a flange 408 and a trip paddle 410 are formed on opposing ends of side portion 404. A substantially planar engagement surface 412 is defined on trip arm 204 proximate to flange 408.

In an exemplary embodiment, guide portion 406 is shaped and sized to receive a portion of pin assembly 208, as described more fully herein. In addition, the shape and size of guide portion 406 are at least partially conformed to a shape and size of slot 310 of support frame 202 such that the portion of pin assembly 208 is received through slot 310 of support frame 202 and through or into guide portion 406 of trip arm 204. Guide portion 406 of trip arm 204 is defined by a top surface 414, a first side surface 416, a bottom surface 418 opposing top surface 414, and a second side surface 420 opposing first side surface 416.

Flange 408 of trip arm 204, in an exemplary embodiment, is sized and shaped to receive at least a portion of flange 312 of support frame 202 such that flange 312 of support frame 202 contacts engagement surface 412 during a trip operation, for example. In an alternative embodiment, any other device or component, such as a support bar (not shown in FIG. 5) may be used to contact engagement surface 412 during the trip operation. Trip paddle 410 is shaped and sized to engage trip mechanism 116 during operation of flux shifter 114, as is described more fully herein.

Figure 6:
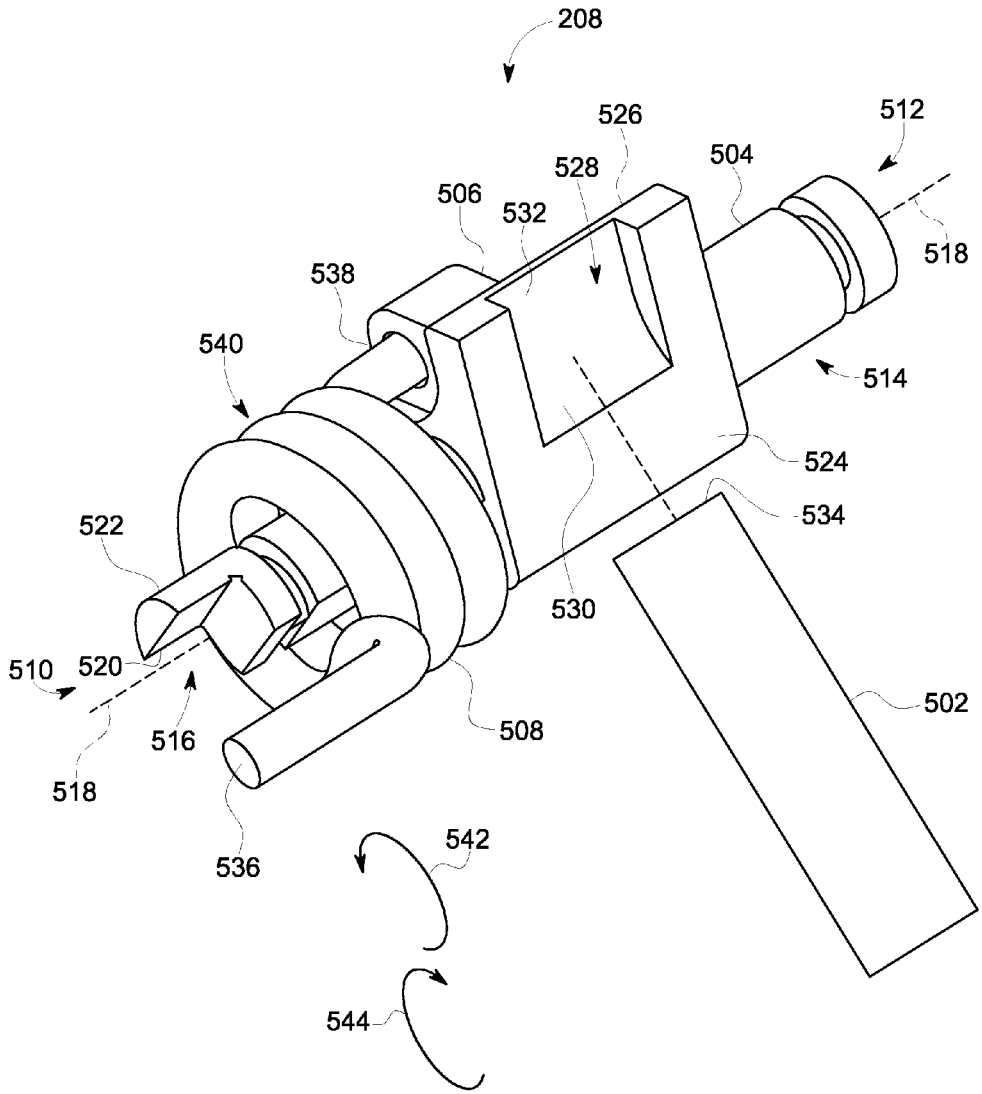
FIG. 6 is a perspective view of an exemplary pin assembly that may be used with the flux shifter shown in FIG. 1.

FIG. 6 is a perspective view of an exemplary pin assembly 208 and a plunger 502 that may be used with flux shifter 114 (shown in FIG. 1). Pin assembly 208 includes a pin 504, a latch 506, and a pin biasing member 508.

Pin 504, and pin assembly 208, are rotatably coupled to support frame 202 (shown in FIG. 2). Pin 504 includes a first end 510, an opposing second end 512, and a body 514 extending between first end 510 and second end 512. First end 510 includes a notch portion 516 that has a substantially circular segment cross-sectional shape (i.e., a "D" shape) when a cross-section is taken in a plane perpendicular to a longitudinal axis 518 of pin 504. Accordingly, notch portion 516 includes a substantially planar inner surface 520 and a substantially arcuate outer surface 522. Alternatively, notch portion 516 may have a rectangular cross-sectional shape, or any suitable cross-sectional shape, that enables pin assembly 208 to function as described herein.

Latch 506 includes a first side 524 and an opposing second side 526. First side 524 is substantially planar, and an impact area 528 is defined within first side 524. Impact area 528 includes a first portion 530 and a second portion 532. In an exemplary embodiment, first portion 530 is substantially arcuate or ramp-shaped, and second portion 532 is substantially planar or ramp-shaped. Alternatively, first portion 530 and/or second portion 532 may have any suitable shape that enables pin assembly 208 to function as described herein. Impact area 528 is sized and shaped to receive at least a portion of plunger 502, such as an impact end 534 of plunger 502. In addition, an opening (not shown) extends through latch 506 to enable pin body 514 to be inserted through, and coupled to, latch 506.

In an exemplary embodiment, pin biasing member 508 is a torsion spring that is positioned proximate to pin 504. For example, as illustrated in FIG. 6, pin biasing member 508 is positioned about pin 504 to at least partially enclose pin 504. Pin biasing member 508 includes a first end 536, a second end 538, and a plurality of windings 540 coupled between first end 536 and second end 538. Second end 538 of pin biasing member 508 is coupled to latch 506, and first end 536 of pin biasing member 508 is positioned proximate to first end 510 of pin 504. As used herein, the term "about" refers to a position of a first object to a second object in which the first object is positioned proximate, near, and/or around the second object.

At least a portion of pin biasing member 508 is rotatable about pin 504, for example, when a force is applied to first end 536 of pin biasing member 508. More specifically, when a force is applied to first end 536 of pin biasing member 508, first end 536 rotates about pin 504 (i.e., about longitudinal axis 518) to compress or expand pin biasing member 508, depending on a direction that first end 536 rotates. When first end 536 rotates in a counterclockwise direction 542, pin biasing member 508 is compressed and mechanical energy is stored within pin biasing member 508. The mechanical energy causes pin biasing member 508 to rotate in a clockwise direction 544 when the force is removed (or when the mechanical energy overcomes the force). When the force is applied to first end 536 such that first end 536 rotates in clockwise direction 544, pin biasing member 508 is expanded and mechanical energy is stored within pin biasing member 508. The mechanical energy causes pin biasing member 508 to rotate in counterclockwise direction 542 when the force is removed (or when the mechanical energy overcomes the force).

In an exemplary embodiment, when pin assembly 208 is coupled to support frame 202, notch portion 516 extends through opening 308 of support frame first side portion 302. In addition, first end 536 of pin biasing member 508 extends through slot 310 of support frame 202 and through, or into, guide portion 406 of trip arm 204.

Figure 7:
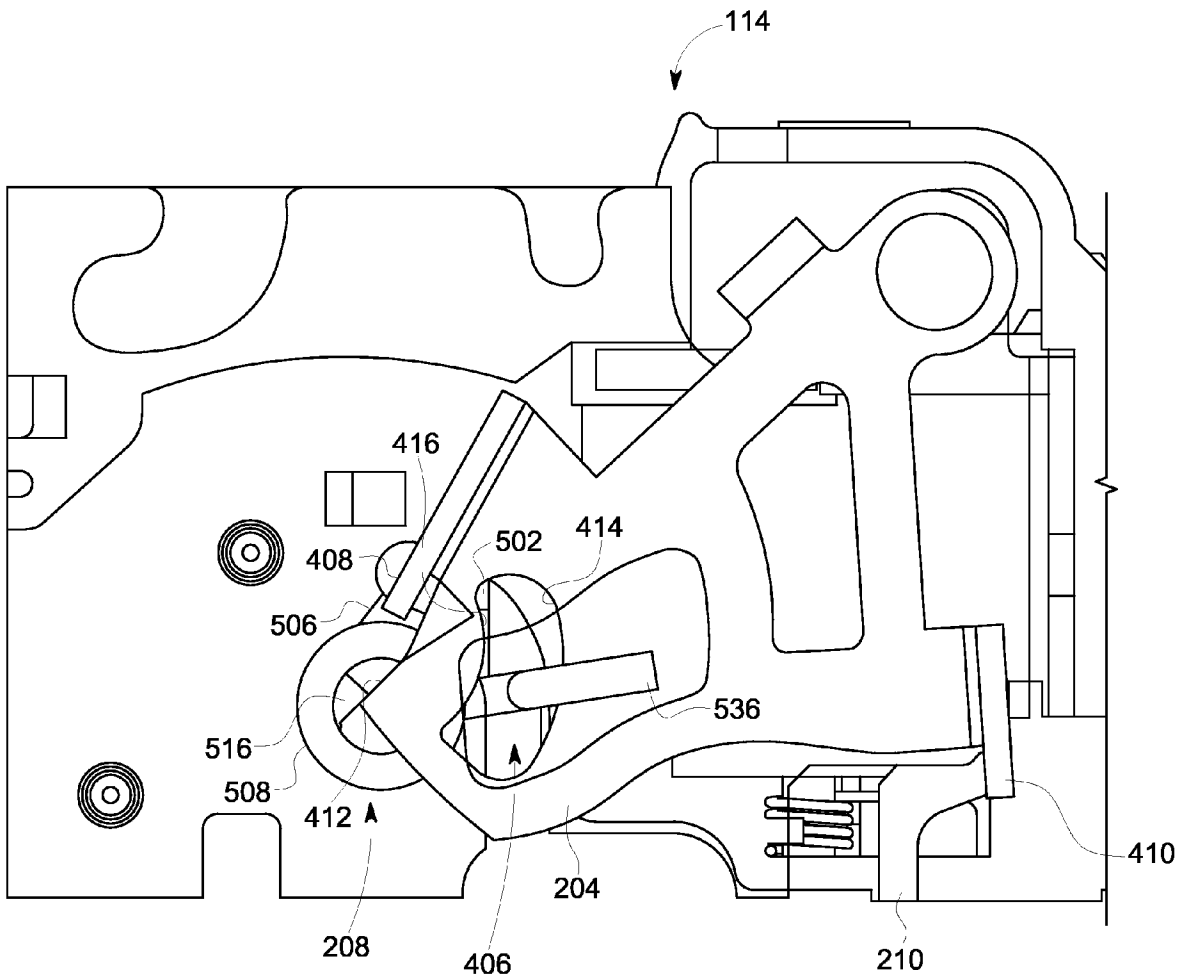
FIG. 7 is a plan view of a flux shifter positioned in an operational state that may be used with the circuit protection device shown in FIG. 1.
Figure 8:
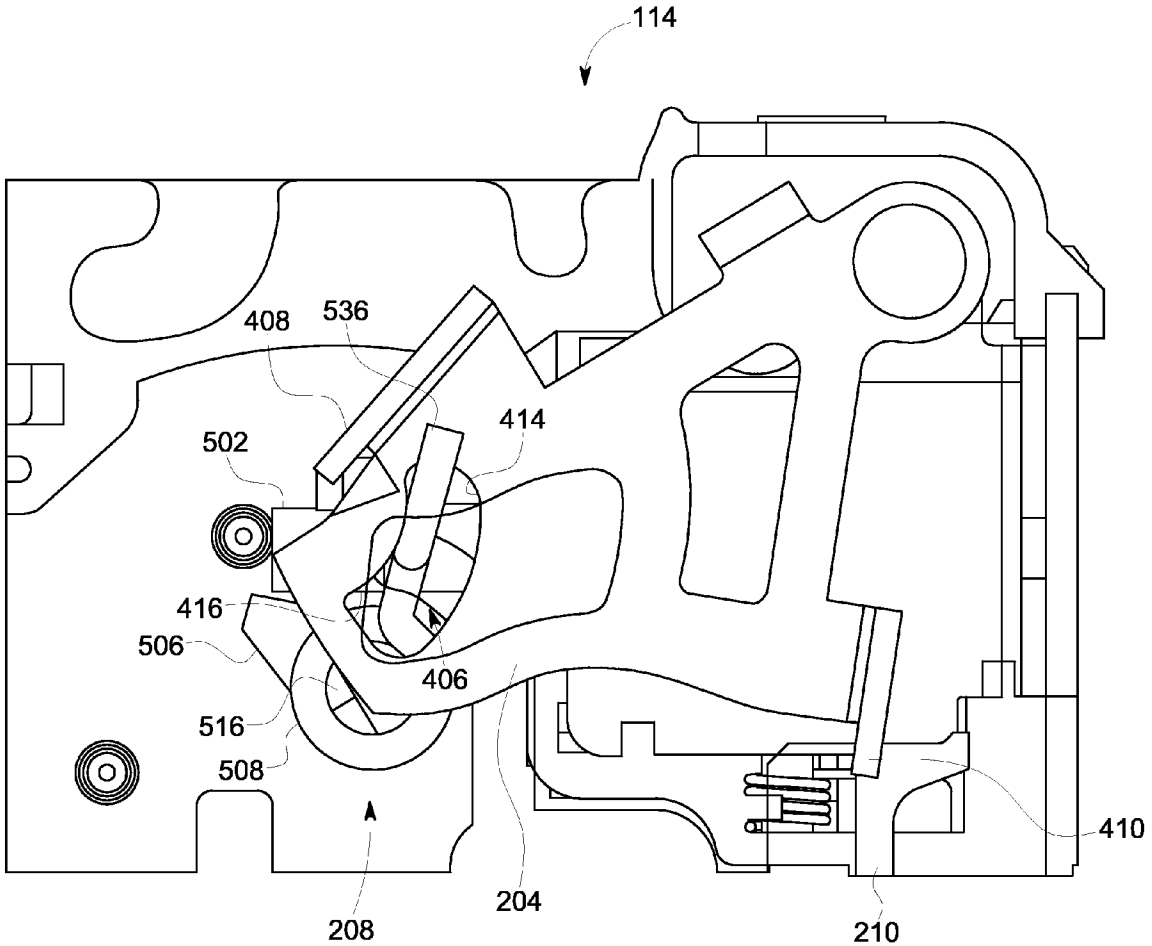
FIG. 8 is a plan view of a flux shifter positioned in a trip state that may be used with the circuit protection device shown in FIG. 1.
Figure 9:
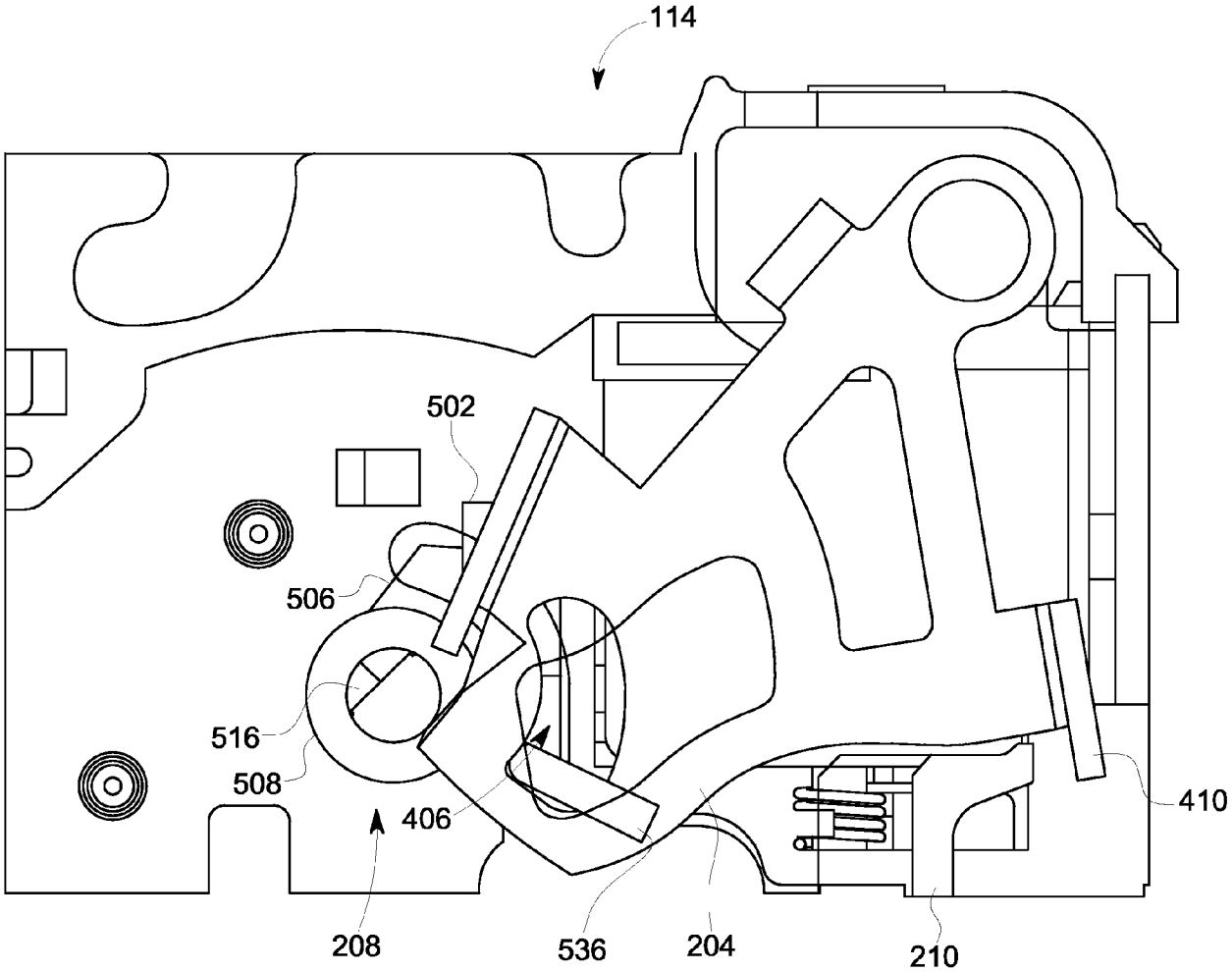
FIG. 9 is a plan view of a flux shifter positioned in a complete reset state that may be used with the circuit protection device shown in FIG. 1.

FIG. 7 is a plan view of an exemplary flux shifter 114 positioned in an operational, or latched, state. FIG. 8 is a plan view of flux shifter 114 positioned in a trip state. FIG. 9 is a plan view of flux shifter 114 positioned in a complete reset state.

As used herein, the term "operational state" refers to a state or a position in which flux shifter 114 has not activated trip mechanism 116. Rather, in the operational state, flux shifter 114 is ready to activate trip mechanism 116 upon receipt of a trip signal from processor 118 or from another device. The "trip state" is a state or a position in which flux shifter 114 activates trip mechanism 116 to interrupt current flowing to load 106. Flux shifter 114 enters the trip state in response to receiving a trip signal. The "reset state" is a state or a position in which flux shifter 114 has been reset to enable flux shifter 114 to enter or re-enter the operational state, for example, after the trip state has been entered. The reset state is entered by performing a reset operation, as described more fully herein.

As shown in FIG. 7, when flux shifter 114 is in the operational state, trip arm 204 is maintained in position by trip arm biasing member 206 and by notch portion 516 of pin 504. More specifically, trip arm biasing member 206 causes a biasing force to be applied to trip arm 204 in clockwise direction 544. Notch portion 516 of pin 504 is aligned with engagement surface 412 of trip arm 204 such that inner surface 520 of notch portion 516 is substantially parallel to engagement surface 412. Accordingly, the biasing force of trip arm biasing member 206 causes trip arm 204 to be maintained in contact with notch portion 516, and notch portion 516 prevents trip arm 204 from rotating further in clockwise direction 544. In addition, latch 506 is maintained in contact with plunger 502 (e.g., with impact end 534 of plunger 502) by a biasing force of pin biasing member 508.

During operation of circuit protection device 102, if the amplitude of the current flowing through trip mechanism 116 exceeds the current threshold, or if another fault is detected, processor 118 (or another device) transmits a trip signal to flux shifter 114. In response to the trip signal, flux shifter 114 generates a magnetic field that causes plunger 502 to be released. Plunger 502 impacts latch 506 at impact area 528 and causes latch 506 to rotate in counterclockwise direction 542.

The rotation of latch 506 causes pin 504, and notch portion 516, to rotate in counterclockwise direction 542. In addition, first end 536 of pin biasing member 508 rotates within guide portion 406 of trip arm 204 and slot 310 of support frame 202 in counterclockwise direction 542. First end 536 contacts top surface 414 and/or first side surface 416 of trip arm guide portion 406 and induces a rotational force to trip arm 204. In addition, the rotation of latch 506 causes notch portion 516 to rotate to a position in which the rotation of trip arm 204 is not obstructed by notch portion 516.

The rotational force of first end 536 and trip arm biasing member 206 causes trip arm 204 to rotate in clockwise direction 544 past notch portion 516. The rotation of trip arm 204 causes trip paddle 410 to engage trip mechanism 116 to open one or more contacts (not shown) to interrupt current flowing through circuit protection device 102.

Referring to FIG. 8, when flux shifter 114 is in the trip state, plunger 502 is maintained in an extended position. Trip arm 204 is maintained in contact with flange 312 of support frame 202 by the biasing force of trip arm biasing member 206 and/or pin biasing member 508. In one embodiment, a user initiates a reset operation to position flux shifter 114 in the reset state (shown in FIG. 9), for example, by engaging a reset button or switch, or by positioning an operating handle (none shown) of circuit protection device 102 in a reset position. The reset operation causes a force to be applied to trip arm 204 in counterclockwise direction 542.

The force applied to trip arm 204 overcomes the biasing force of trip arm biasing member 206 and/or pin biasing member 508 such that trip arm 204 rotates in counterclockwise direction 542. First side surface 416 of trip arm guide portion 406 displaces first end 536 of pin biasing member 508 in clockwise direction 544 about pin 504. The displacement of first end 536 causes mechanical energy to be stored within pin biasing member 508. Initially, pin 504 is prevented from rotating because notch portion 516 of pin 504 is maintained in position by trip arm 204. When trip arm 204 rotates past a center of notch portion 516, pin 504 is enabled to rotate. A force applied to trip arm 204 causes pin 504 and latch 506 to rotate in clockwise direction 544, thus displacing plunger 502 into a refracted, or latched, position shown in FIG. 9.

Figure 10:
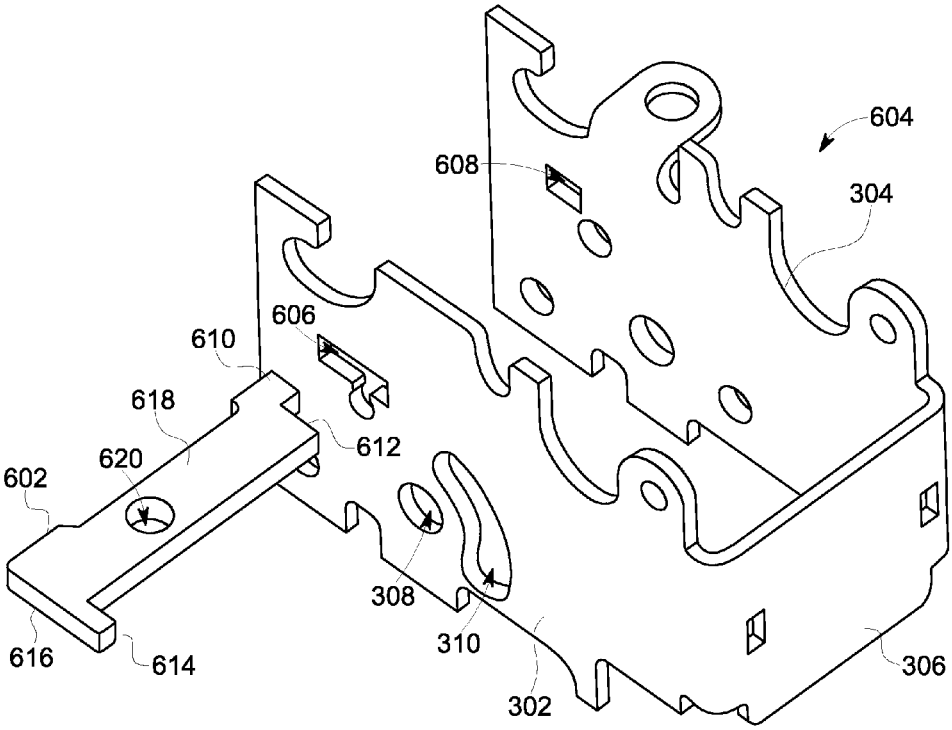
FIG. 10 is a perspective view of an exemplary support bar and support frame that may be used with the flux shifter shown in FIG. 1.

FIG. 10 is a perspective view of an exemplary support bar 602 and an exemplary support frame 604 that may be used with flux shifter 114 (shown in FIG. 1). More specifically, in an exemplary embodiment, flux shifter 114 may include support bar 602 in place of flange 312 (shown in FIG. 4). Support frame 604 is substantially similar to support frame 202 (shown in FIG. 2), and similar components are labeled in FIG. 10 with the same reference numerals used in FIG. 2.

In an exemplary embodiment, support frame 604 includes a first opening 606 (in place of opening 308 shown in FIG. 2) that is shaped and sized to receive at least a first portion of support bar 602. First opening 606 is substantially rectangular and extends through first side portion 302 of support frame 604. Support frame 604 also includes a second opening 608 that is shaped and sized to receive at least a second portion of support bar 602. In an exemplary embodiment, second opening 608 is substantially rectangular and extends through second side portion 304 of support frame 604.

Support bar 602, in an exemplary embodiment, is a substantially flat rectangular bar that is shaped and sized to be at least partially inserted through first opening 606. More specifically, a first flange 610 is formed at a first end portion 612, and a second flange 614 is formed at a second end portion 616 of support bar 602. A body 618 of support bar 602 extends between first end portion 612 and second end portion 616, and an opening 620 is defined that extends through body 618.

During assembly, first end portion 612 is inserted through first opening 606 and is positioned against second side portion 304 such that first flange 610 at least partially extends through second opening 608. When first end portion 612 is positioned against second side portion 304, second flange 614 is prevented from extending through first opening 606 and is positioned against first side portion 302. Accordingly, support bar 602 is prevented from rotating or being displaced during operation of flux shifter 114 by the rectangular shape of first opening 606 and second opening 608 that substantially conform to the shape of support bar 602. As described more fully herein, support bar 602 facilitates supporting and limiting a movement of plunger 502.

Figure 11:
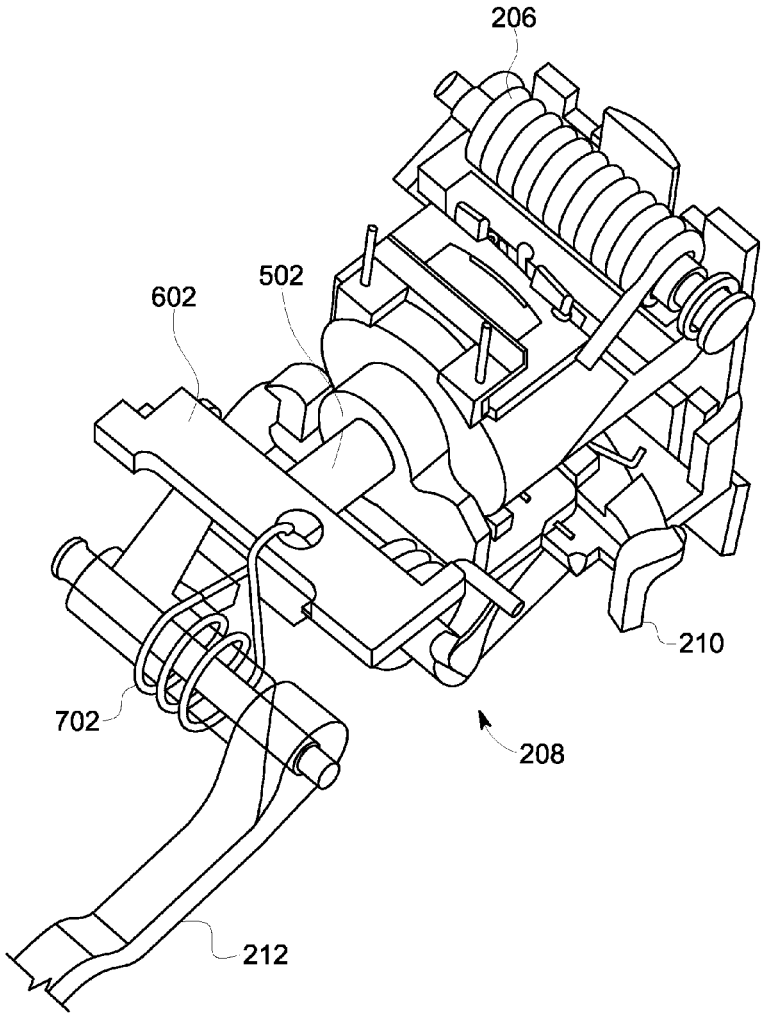
FIG. 11 is a perspective view of an exemplary flux shifter including the support bar shown in FIG. 10.
Figure 12:
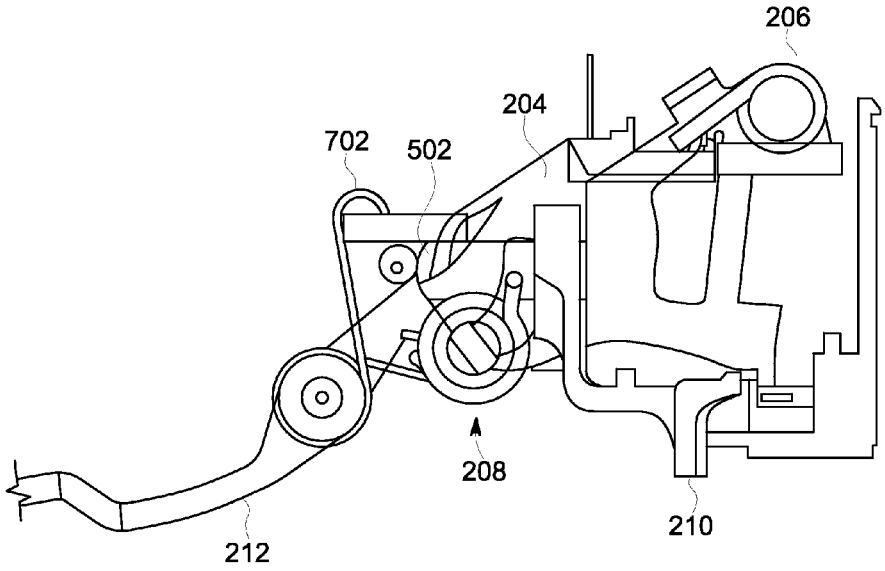
FIG. 12 is a side view of the flux shifter shown in FIG. 11.

FIG. 11 is a perspective view of an exemplary flux shifter 114 including support bar 602. FIG. 12 is a side view of flux shifter 114. In an exemplary embodiment, support bar 602 is coupled to bell alarm 212 by a biasing member 702, such as a spring 702. More specifically, at least a portion of biasing member 702 extends through opening 620 and is retained in position by support bar 602.

Referring to FIG. 12, body 618 of support bar 602 is positioned above plunger 502 to prevent plunger 502 from being displaced in an upward direction by pin assembly 208. In addition, support bar 602 is shaped and sized to engage a portion of trip arm 204, such as engagement surface 412, and to limit a rotational movement of the portion. For example, if flux shifter 114 enters the trip state, for example, support bar 602 stops the rotation of trip arm 204 after trip paddle 410 has engaged trip mechanism 116.

Figure 13:
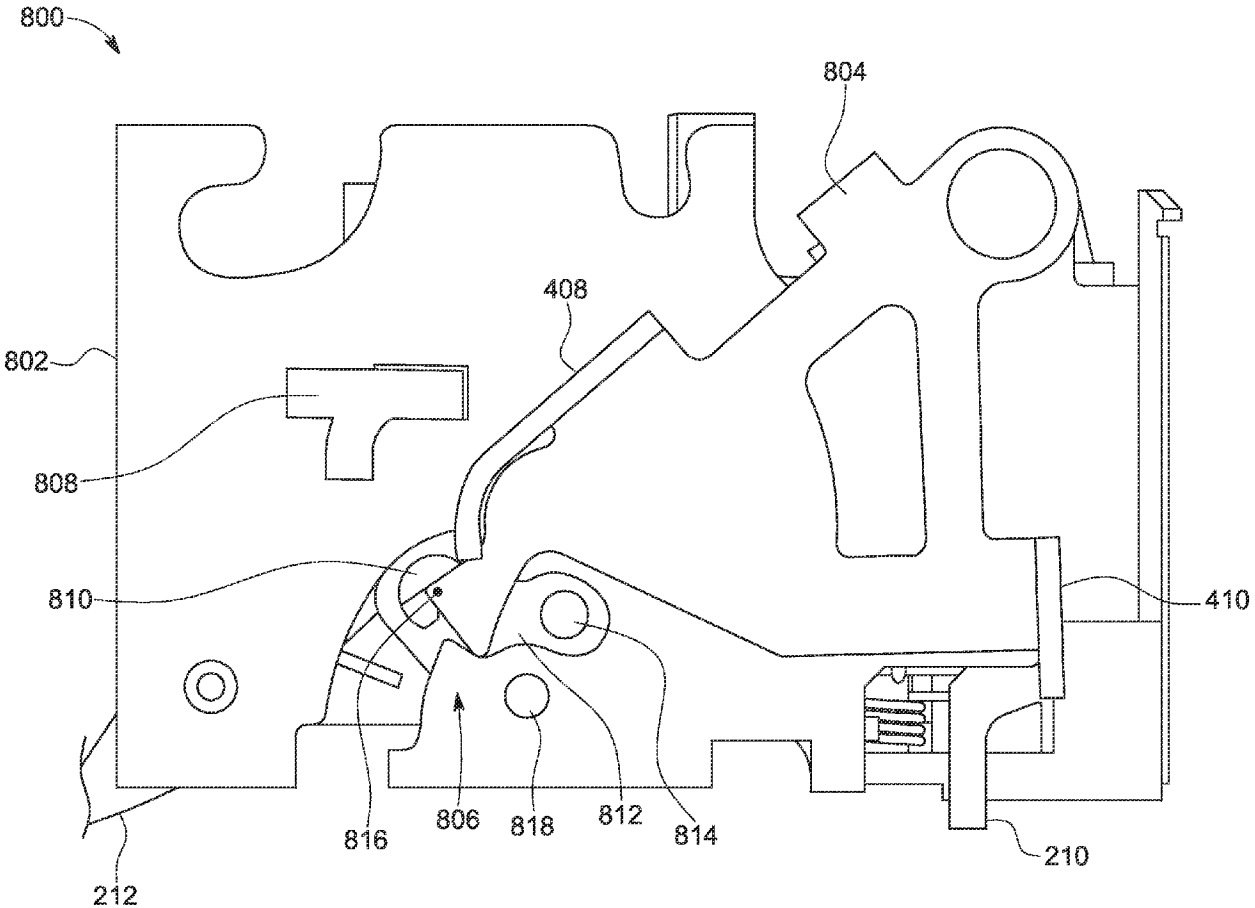
FIG. 13 is a side view of a portion of another exemplary flux shifter that may be used with the circuit protection device shown in FIG. 1.
Figure 14:
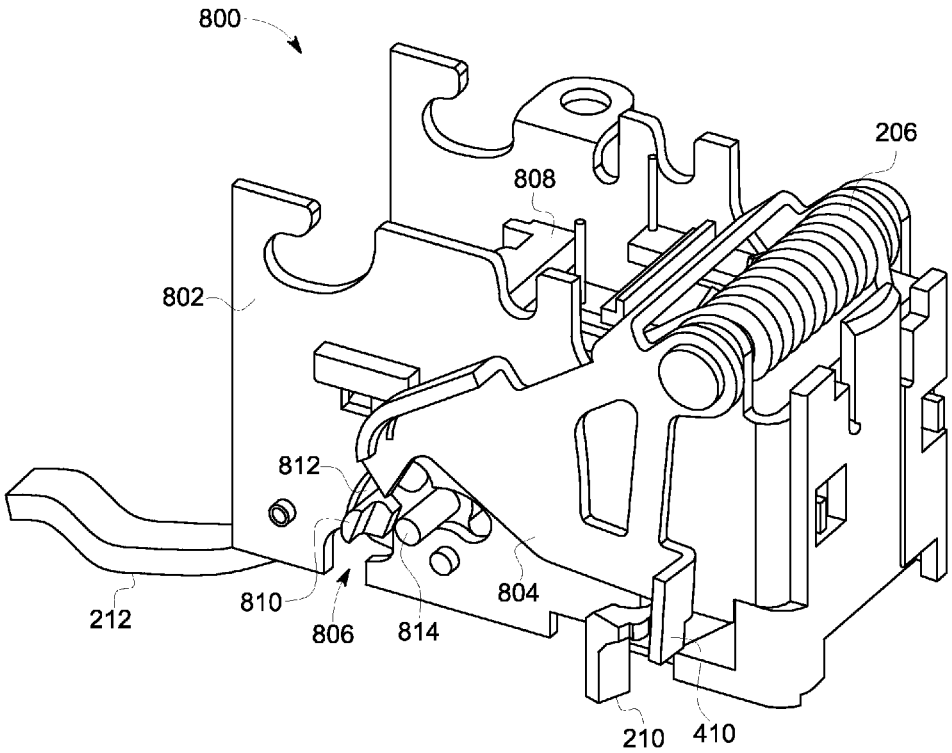
FIG. 14 is a perspective view of the flux shifter shown in FIG. 13.

FIG. 13 is a side view of a portion of another exemplary flux shifter 800 that may be used with circuit protection device 102. FIG. 14 is a perspective view of flux shifter 800. Unless otherwise specified, flux shifter 800 is substantially similar to flux shifter 114 (shown in FIG. 2), and similar components are labeled in FIG. 13 with the same reference numerals used in FIG. 2.

In an exemplary embodiment, flux shifter 800 includes a support frame 802, a trip arm 804, a pin assembly 806, trip arm biasing member 206, lever 210, and bell alarm 212. Flux shifter 800 also includes a support bar 808 shaped to engage with plunger 502 (shown in FIG. 6). In an exemplary embodiment, pin assembly 806 includes an engagement pin 810, a latch 812, and a reset pin 814. Engagement pin 810 is positioned about a pin axis 816, and pin assembly 806 (e.g., latch 812) rotates about a reset axis 818 during a reset operation of flux shifter 800.

In an exemplary embodiment, pin assembly 806 is configured to enable trip arm 804 to rotate into engagement with trip mechanism 116 when flux shifter 800 enters a trip state. In addition, pin assembly 806 is configured to prevent trip arm 804 from rotating into engagement with trip mechanism 116 when flux shifter 800 is in an operational state or a reset state.

During a trip operation of flux shifter 800, the solenoid receives a trip signal and generates an electromagnetic field that opposes a permanent magnet (not shown) that holds plunger 502 in the retracted position. The electromagnetic field effectively cancels the field generated by the permanent magnet, and spring elastic energy of a spring (not shown) coupled to plunger 502 is converted to kinetic energy. Plunger 502 is propelled out of the solenoid by the kinetic energy and impacts latch 812, causing latch 812 to rotate. The rotation of latch 812 enables engagement pin 810 to slide with respect to trip arm 804. An engagement or a contact between trip arm 804 and engagement pin 810 reduces due to the sliding movement of engagement pin 810 with respect to trip arm 804. Trip arm 804 is enabled to rotate when trip arm 804 slides past a midpoint (e.g., pin axis 816) of engagement pin 810. More specifically, the biasing force of trip arm biasing member 206 causes trip arm 804 to rotate past a notch portion of engagement pin 810. Trip paddle 410 rotates into an engagement with trip mechanism 116 to cause trip mechanism 116 to activate, thus interrupting current flowing to a load 106.

During a reset operation of flux shifter 800 (i.e., when flux shifter 800 enters the reset state), trip arm 804 rotates by an application of force from a handle assembly (not shown) on a surface of trip arm 804. A curved portion at a bottom of trip arm 804 engages reset pin 814. Trip arm 804 causes a force to be applied to reset pin 814, thus causing pin assembly 806 (e.g., latch 812) to rotate in a clockwise direction about reset axis 818. The rotation of latch 812 causes plunger 502 to be moved to the retracted position. When the handle assembly reaches the reset state, trip arm 804 is positioned against a surface of engagement pin 810. As such, the notch portion of engagement pin 810 contacts trip arm 804 and prevents trip arm 804 from rotating into engagement with trip mechanism 116 when flux shifter 800 is in the reset state (or when flux shifter 800 is in an operational state described above). Accordingly, flux shifter 800 described herein provides a robust and effective trip activation and latching functionality to circuit protection device 102 using fewer components than at least some known flux shifters. In addition, the rotatable parts of pin assembly 806 facilitate reducing vibrations that may otherwise be present within flux shifter 800 due to the operation of plunger 502.

Figure 15:
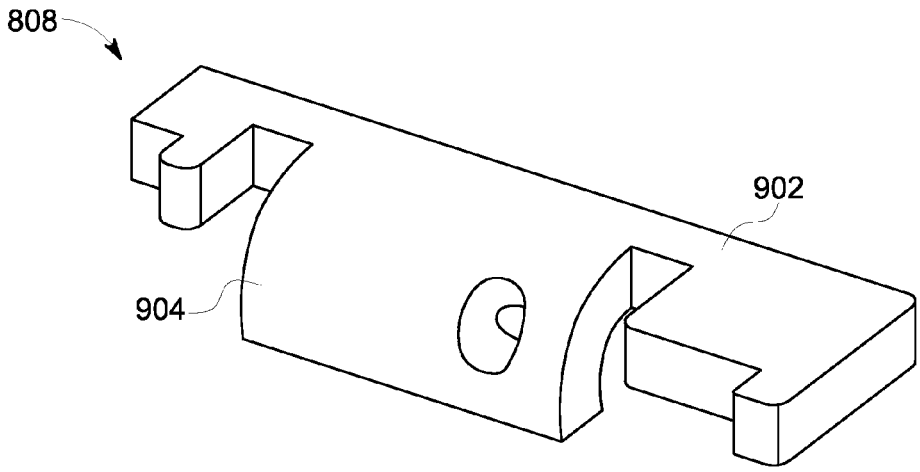
FIG. 15 is a perspective view of an exemplary support bar that may be used with the flux shifter shown in FIG. 13.

FIG. 15 is a perspective view of an exemplary support bar 808 that may be used with flux shifter 800 (shown in FIG. 13). Unless otherwise specified, support bar 808 is substantially similar to support bar 602 (shown in FIG. 10), and similar components are labeled in FIG. 15 with the same reference numerals used in FIG. 10.

In an exemplary embodiment, support bar 808 includes a substantially planar portion 902 and a curved portion 904. Planar portion 902 engages with support frame 802 to retain support bar 808 within support frame 802. Curved portion 904 engages with plunger 502 to stop the movement of plunger 502 after plunger 502 rotates latch 812 during a trip operation of flux shifter 800. It should be recognized that curved portion 904 facilitates reducing an amount of vibration that may otherwise occur when plunger 502 impacts support bar 808.

Figure 16:
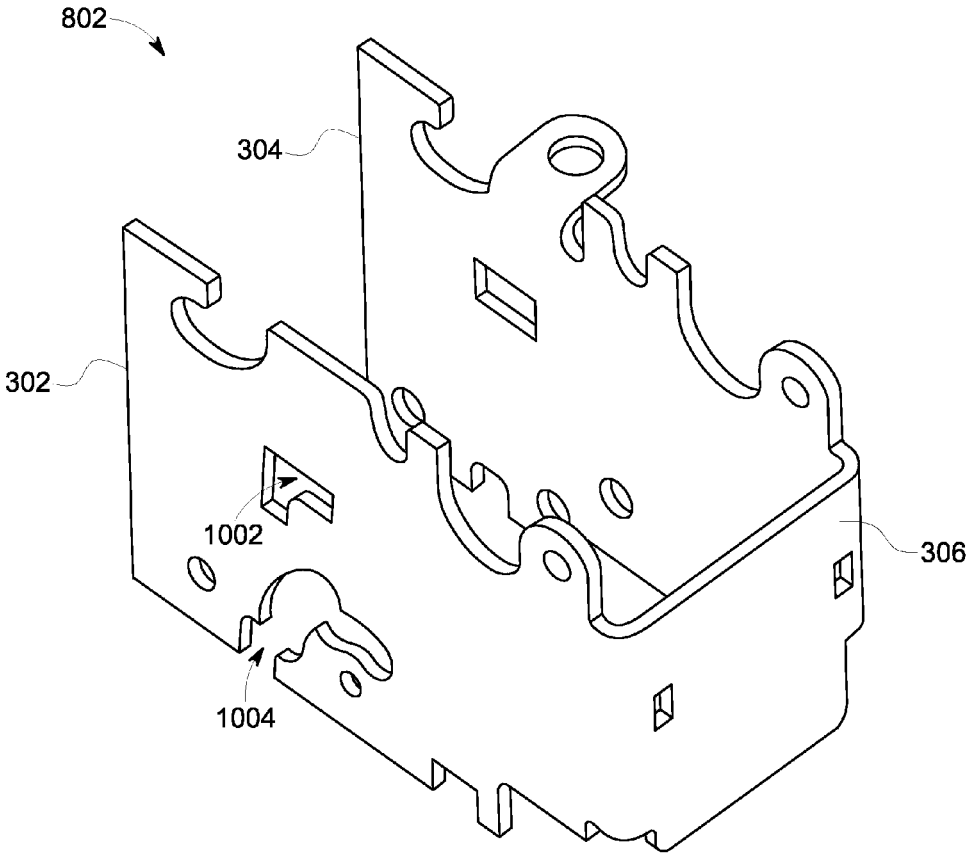
FIG. 16 a perspective view of an exemplary support frame that may be used with the flux shifter shown in FIG. 13.

FIG. 16 is a perspective view of an exemplary support frame 802 that may be used with flux shifter 800 (shown in FIG. 13). Unless otherwise specified, support frame 802 is substantially similar to support frame 202 (shown in FIG. 4), and similar components are labeled in FIG. 16 with the same reference numerals used in FIG. 4.

In an exemplary embodiment, support frame 802 includes first side portion 302, second side portion 304, and connecting portion 306. An opening 1002 and a slot or channel 1004 are defined within first side portion 302. In an exemplary embodiment, opening 1002 is substantially L-shaped to receive support bar 808, and slot 1004 is substantially arcuate for receiving one or more portions of pin assembly 806 therethrough. Alternatively, opening 1002 and/or slot 1004 may have any suitable shape that enables flux shifter 800 to function as described herein.

Figure 17:
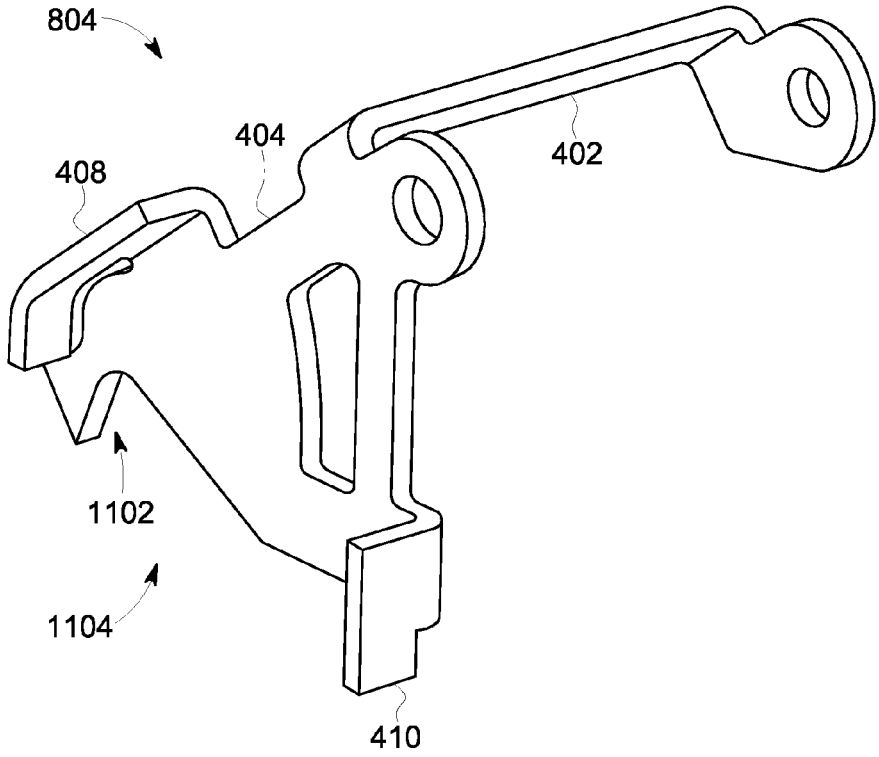
FIG. 17 is a perspective view of an exemplary trip arm that may be used with the flux shifter shown in FIG. 13.

FIG. 17 is a perspective view of an exemplary trip arm 804 that may be used with flux shifter 800 (shown in FIG. 13). Unless otherwise specified, trip arm 804 is substantially similar to trip arm 204 (shown in FIG. 5), and similar components are labeled in FIG. 17 with the same reference numerals used in FIG. 5.

Trip arm 804 includes a curved portion 1102 defined at a bottom 1104 of trip arm 804. Curved portion 1102 engages with reset pin 814 to move pin assembly 806 and plunger 502 to a retracted position during a reset operation of flux shifter 800. In addition, trip arm 804 engages with engagement pin 810 during operation of flux shifter 800 as described above.

Figure 18:
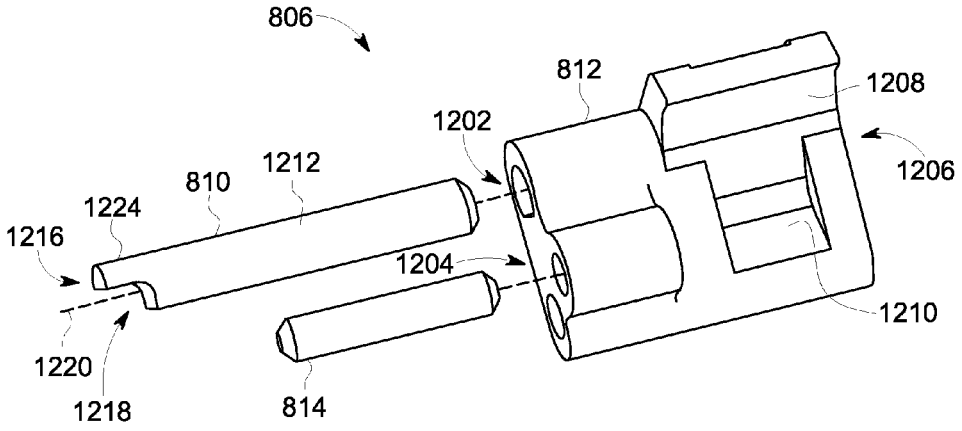
FIG. 18 is an exploded view of an exemplary pin assembly that may be used with the flux shifter shown in FIG. 13.
Figure 19:
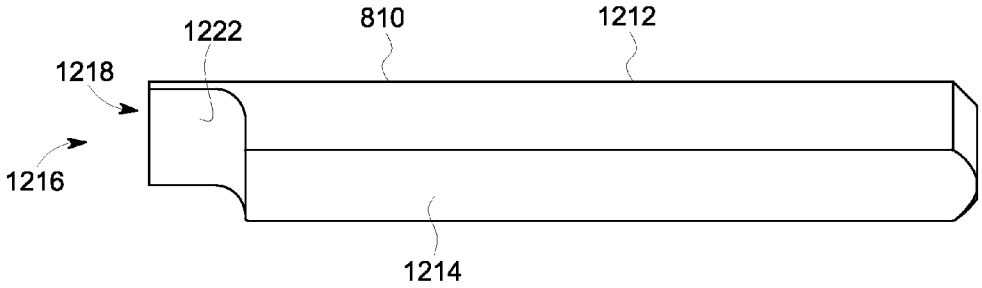
FIG. 19 is a perspective view of an exemplary engagement pin that may be used with the flux shifter shown in FIG. 13.

FIG. 18 is an exploded view of an exemplary pin assembly 806 that may be used with flux shifter 800 (shown in FIG. 13). FIG. 19 is a perspective view of an exemplary engagement pin 810 that may be used with flux shifter 800 (shown in FIG. 13) and pin assembly 806. Unless otherwise specified, pin assembly 806 is substantially similar to pin assembly 208 (shown in FIG. 6), and similar components are labeled in FIGS. 18 and 19 with the same reference numerals used in FIG. 6.

In an exemplary embodiment, pin assembly 806 includes latch 812, engagement pin 810, and reset pin 814. Latch 812 includes a first opening 1202 for receiving engagement pin 810 and a second opening 1204 for receiving reset pin 814. Accordingly, when flux shifter 800 is assembled, engagement pin 810 and reset pin 814 are coupled to latch 812.

In addition, an impact area 1206 is defined within latch 812. Impact area 1206 includes a first portion 1208 and a second portion 1210. In an exemplary embodiment, first portion 1208 and second portion 1210 are substantially perpendicular to each other. First portion 1208 is aligned substantially perpendicular to plunger 502 when flux shifter 800 is in the reset state, and second portion 1210 is aligned substantially parallel to plunger 502 when flux shifter 800 is in the reset state. In addition, second portion 1210 is shaped as a channel to receive impact end 534 of plunger 502.

Unless otherwise specified, engagement pin 810 is substantially similar to pin 504 (shown in FIG. 6). Engagement pin 810 includes a body 1212 having a substantially planar first side 1214. A first end 1216 of body 1212 includes a notch portion 1218 that has a substantially circular segment cross-sectional shape (e.g., a "D" shape) when a cross-section is taken in a plane perpendicular to a longitudinal axis 1220 of engagement pin 810. In one embodiment, longitudinal axis 1220 is the same as, or coaxial with, pin axis 816 (shown in FIG. 13). Accordingly, notch portion 1218 includes a substantially planar inner surface 1222 and a substantially arcuate outer surface 1224. Alternatively, notch portion 1218 may have a rectangular cross-sectional shape, or any suitable cross-sectional shape, that enables pin assembly 806 to function as described herein.

Exemplary embodiments of a circuit protection device and a flux shifter for a circuit protection device are described above in detail. The devices are not limited to the specific embodiments described herein but, rather, components of the devices may be utilized independently and separately from other operations and/or components described herein. Further, the described operations and/or components may also be defined in, or used in combination with, other systems, methods, and/or devices, and are not limited to practice with power distribution system as described herein.

Although the present invention is described in connection with an exemplary power distribution system, embodiments of the invention are operational with numerous other power systems, or other systems or devices. The circuit protection device described herein is not intended to suggest any limitation as to the scope of use or functionality of any aspect of the invention. In addition, the circuit protection device described herein should not be interpreted as having any dependency or requirement relating to any one or combination of components illustrated in the exemplary operating environment.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A flux shifter for a circuit protection device including a trip mechanism, said flux shifter comprising:

a trip arm; and a pin assembly comprising:

a pin;

a biasing member positioned proximate to said pin; and a latch coupled to said pin and to said biasing member, wherein said pin assembly is configured to enable said trip arm to rotate into an engagement with the trip mechanism when said flux shifter enters a trip state and to prevent said trip arm from rotating into the engagement with the trip mechanism when said flux shifter is in one of an operational state and a reset state.

2. A flux shifter in accordance with claim 1, further comprising a plunger configured to activate said pin assembly to enable said trip arm to rotate into the engagement with the trip mechanism.

3. A flux shifter in accordance with claim 2, wherein said latch comprises an impact area, said plunger configured to contact said impact area to rotate said pin assembly.

4. A flux shifter in accordance with claim 1, wherein a guide portion is formed within said trip arm, and wherein a portion of said pin assembly extends into the guide portion.

5. A flux shifter in accordance with claim 4, wherein said biasing member comprises an end extending into the guide portion.

6. A flux shifter in accordance with claim 5, wherein said trip arm comprises at least one edge defining the guide portion, said end configured to rotate through the guide portion and contact said at least one edge to enable said trip arm to rotate into the engagement with the trip mechanism.

7. A flux shifter in accordance with claim 5, further comprising a support frame, wherein an arcuate slot is formed within said support frame, and wherein said end extends through the arcuate slot.

8. A flux shifter in accordance with claim 1, wherein said pin comprises a notch portion configured to contact said trip arm.

9. A flux shifter in accordance with claim 8, wherein said notch portion is configured to prevent said trip arm from rotating into the engagement with the trip mechanism when said flux shifter is in one of the operational state and the reset state.

10. A flux shifter in accordance with claim 9, further comprising a plunger configured to cause said notch portion to rotate into a position in which said trip arm is enabled to rotate into the engagement with the trip mechanism when said flux shifter enters the reset state.

11. A circuit protection device comprising:

a trip mechanism configured to interrupt a current; and a flux shifter configured to activate said trip mechanism to interrupt the current, said flux shifter comprising:

a trip arm; and a pin assembly comprising:

a pin;

a biasing member positioned proximate to said pin; and a latch coupled to said pin and to said biasing member, wherein said pin assembly is configured to enable said trip arm to rotate into an engagement with said trip mechanism when said flux shifter enters a trip state and to prevent said trip arm from rotating into the engagement with said trip mechanism when said flux shifter is in one of an operational state and a reset state.

12. A circuit protection device in accordance with claim 11, further comprising a plunger configured to activate said pin assembly to enable said trip arm to rotate into the engagement with said trip mechanism.

13. A circuit protection device in accordance with claim 12, wherein said latch comprises an impact area, said plunger configured to contact said impact area to rotate said pin assembly.

14. A circuit protection device in accordance with claim 11, wherein a guide portion is formed within said trip arm, and wherein a portion of said pin assembly extends into the guide portion.

15. A circuit protection device in accordance with claim 14, wherein said biasing member comprises an end extending into the guide portion.

16. A circuit protection device in accordance with claim 15, wherein said trip arm comprises at least one edge defining the guide portion, said end configured to rotate through the guide portion and contact said at least one edge to enable said trip arm to rotate into the engagement with said trip mechanism.

17. A circuit protection device in accordance with claim 15, further comprising a support frame, wherein an arcuate slot is formed within said support frame, and wherein said end extends through the arcuate slot.

18. A circuit protection device in accordance with claim 11, wherein said pin comprises a notch portion configured to contact said trip arm.

19. A circuit protection device in accordance with claim 18, wherein said notch portion is configured to prevent said trip arm from rotating into the engagement with said trip mechanism when said flux shifter is in one of the operational state and the reset state.

20. A circuit protection device in accordance with claim 19, further comprising a plunger configured to cause said notch portion to rotate into a position in which said trip arm is enabled to rotate into the engagement with said trip mechanism when said flux shifter enters the reset state.

21. A flux shifter for a circuit protection device including a trip mechanism, said flux shifter comprising:

a trip arm; and a pin assembly comprising:

a latch;

an engagement pin coupled to said latch; and a reset pin coupled to said latch;

wherein said pin assembly is configured to enable said trip arm to rotate into an engagement with the trip mechanism when said flux shifter enters a trip state and to prevent said trip arm from rotating into the engagement with the trip mechanism when said flux shifter is in one of an operational state and a reset state.

22. A flux shifter in accordance with claim 21, further comprising a plunger configured to activate said pin assembly to enable said trip arm to rotate into the engagement with the trip mechanism.

23. A flux shifter in accordance with claim 22, wherein said latch comprises an impact area, said plunger configured to contact said impact area to rotate said pin assembly.

24. A flux shifter in accordance with claim 21, wherein said engagement pin comprises a notch portion configured to contact said trip arm.

25. A flux shifter in accordance with claim 24, wherein said notch portion is configured to prevent said trip arm from rotating into the engagement with the trip mechanism when said flux shifter is in one of the operational state and the reset state.

26. A flux shifter in accordance with claim 21, wherein said engagement pin is positioned about a pin axis, said latch is configured to rotate about a reset axis that is different than the pin axis.

* * * * *

UNITED STATES PATENT AND TRADEMARK OFFICE

CERTIFICATE OF CORRECTION

PATENT NO. : 8,471,654 B1
APPLICATION NO. : 13/660539
DATED : June 25, 2013
INVENTOR(S) : Shanmugaraj et al.

It is certified that error appears in the above-identified patent and that said Letters Patent is hereby corrected as shown below:

In the Specification

In Column 9, Line 5, delete "refracted," and insert -- retracted, --, therefor.

Signed and Sealed this
Twenty-fourth Day of September, 2013

Teresa Stanek Rea
*Deputy Director of the United States Patent and Trademark Office*